US005990073A

United States Patent [19]

Garcia et al.

[11] Patent Number: 5,990,073

[45] **Date of Patent: *Nov. 23, 1999**

[54] PROCESS FOR THE PRODUCTION OF A DETERGENT COMPOSITION

[75] Inventors: Marcelito Abad Garcia; David Alan Jordan, both of Jeddah, Saudi Arabia; Donald Peter; Chandulal Kantilal Ranpuria, both of Wirral, United Kingdom

[73] Assignee: Lever Brothers Company, New York, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/672,770

[22] Filed: Jun. 28, 1996

[30] Foreign Application Priority Data

Jun. 30, 1995 [GB] United Kingdom ..... 9513327

[51] Int. Cl.[6] ..... C11D 11/00

[52] U.S. Cl. ..... 510/444; 510/507; 510/509; 510/510; 510/511; 264/117; 264/140

[58] Field of Search ..... 510/444, 507, 510/509, 510, 511; 264/117, 140

[56] References Cited

U.S. PATENT DOCUMENTS

| | | | |
|---|---|---|---|
| 4,196,093 | 4/1980 | Clarke et al. | 510/317 |
| 4,767,570 | 8/1988 | Joubert | 510/444 |
| 4,828,721 | 5/1989 | Bollier et al. | 510/308 |
| 5,080,848 | 1/1992 | Strauss et al. | 264/117 |
| 5,164,108 | 11/1992 | Appel et al. | 510/444 |
| 5,188,786 | 2/1993 | Wilms et al. | 264/117 |
| 5,354,493 | 10/1994 | Wilms | 510/444 |
| 5,366,652 | 11/1994 | Capeci et al. | 510/444 |
| 5,397,507 | 3/1995 | Bauer et al. | 510/444 |
| 5,468,516 | 11/1995 | Yamashita et al. | 427/180 |
| 5,490,954 | 2/1996 | Van Der Hoeven et al. | 510/444 |
| 5,576,285 | 11/1996 | France et al. | 510/444 |
| 5,616,550 | 4/1997 | Kruse et al. | 510/444 |
| 5,629,275 | 5/1997 | Bauer et al. | 510/108 |
| 5,736,501 | 4/1998 | Yamashita et al. | 510/444 |

FOREIGN PATENT DOCUMENTS

| | | |
|---|---|---|
| 342 043 | 11/1989 | European Pat. Off. . |
| 367 339 | 5/1990 | European Pat. Off. . |
| 430 328 | 6/1991 | European Pat. Off. . |
| 510 746 | 10/1992 | European Pat. Off. . |
| 544 365 | 6/1993 | European Pat. Off. . |
| 1 603 810 | 6/1971 | France . |
| 2514677 | 10/1975 | Germany . |
| 5202399 | 8/1993 | Japan . |
| 1 495 144 | 12/1977 | United Kingdom . |
| 2 029 854 | 3/1980 | United Kingdom . |
| 9323523 | 11/1993 | WIPO . |
| WO 95/14766 | 6/1995 | WIPO . |
| 9728246 | 8/1997 | WIPO . |

*Primary Examiner*—Lorna M. Douyon
*Attorney, Agent, or Firm*—Rimma Mitelman

[57] ABSTRACT

A process for the production of a detergent composition or component having a bulk density of less than 700 g/l which involves mixing a particulate starting material compound with a liquid binder in a mixer/granulator having both a stirring and a cutting action wherein the starting material contains a component, which is not a detergent active compound, having a bulk density of not more than 600 g/l is disclosed.

14 Claims, No Drawings

PROCESS FOR THE PRODUCTION OF A DETERGENT COMPOSITION

The present invention relates to a process for the production of a detergent composition. In particular the invention is concerned with a process for the production of a detergent composition having good porosity and medium bulk density without the use of a spray-drying step and to detergent compositions thereby produced.

Conventionally, detergent compositions have been produced by a spray-drying process in which the components of the composition are mixed with water to form an aqueous crutcher slurry which is then sprayed into a spray-drying tower and contacted with hot air to remove water whereby detergent particles, often referred to as a "base" powder are obtained. The particles so obtained have a high porosity. Thus powders produced by this method typically have a bulk density of 300 to 550 g/l or even up to 650 g/l.

Spray-dried powders generally provide good powder delivery characteristics such as dispensing and dissolution. However, the capital and operating costs of the spray-drying process are high. Nevertheless there remains a significant consumer demand for such low density powders.

In recent years, detergent powders having a high bulk density have been produced by mechanical mixing processes. Bulk densities of 700 to 900 g/l and even higher have been obtained. Typically such powders are produced by densifying a spray-dried base powder in one or more mechanical mixers, optionally with the addition of further components, or by mixing the components of the composition in a continuous or batch mixing process without the use of a spray-drying step.

EP 367 339 (Unilever) discloses a process for the production of a detergent composition having a high bulk density in which a particulate starting material is treated in a high speed mixer, a moderate speed mixer wherein the material is brought into or maintained in a deformable state, and then dried and/or cooled. The starting material may be a spray-dried base powder or the components of the composition may be employed without a prior spray-drying step in the detergent production process.

Powders having a high bulk density have a low packing volume which is advantageous for storage and distribution operations and also for the consumer. The avoidance of a spray-drying step in the detergent production process is therefore desirable.

However, such high density powders typically have a much lower porosity than a conventional spray-dried powder which may impair the delivery of the powder into the wash liquor. Additionally, the production of powders having high porosity and low to medium bulk density, for example less than about 700 g/l, has not hitherto been readily achievable on a commercial scale without the use of a spray-drying step.

EP 544 365 (Unilever) is concerned with the production of a high bulk density detergent composition and refers to the bulk density of a detergent powder being dependent upon the bulk density of the starting materials in the case of a mixing process.

Treating a porous spray-dried material in a mechanical mixing process typically leads to a decrease in porosity and a consequential increase in bulk density as the powder porosity is reduced. However, we have found that a powder having a surprisingly low bulk density, for example less than 700 g/l and good porosity, may be obtained by a process in which a spray-drying step is not employed, if the composition is formulated with a component having a low bulk density. Further, such a powder exhibits good powder properties.

A first aspect of the invention provides a process for the production of a detergent composition or component having a bulk density of less than 700 g/l which does not comprise a spray-drying step and which process comprises mixing a particulate starting material comprising at least 10 wt % of a component having a bulk density of not more than 600 g/l and which is not a detergent active compound with a liquid binder in a mixer granulator having both a stirring and a cutting action to form granules having a bulk density of less than 700 g/l wherein the particulate starting material comprises a detergent builder and the starting material and/or binder comprises a non-soap detergent active or a precursor thereof.

A second aspect of the invention provides a detergent composition or component having a bulk density of less than 700 g/l obtainable by a process which does not comprise a spray-drying step and which comprises mixing a particulate starting material comprising a component having a bulk density of not more than 600 g/l and which is not a detergent-active compound with a liquid binder in a mixer having both a stirring and cutting action.

Unless stated otherwise, % figures are on a weight basis and based on the total weight of the detergent composition or component prior to the optional addition of post-dosed ingredients.

Suitably the detergent composition has a bulk density of 400 to 680 g/l, preferably 450 to 680 g/l and more preferably 500 to 650 g/l. It is further preferred that the detergent composition has a particle porosity of at least 0.2 and more preferably at least 0.25.

According to the invention, the particulate starting material contains a low bulk density component.

Suitably the low bulk density component is present at a level of 10 to 45 wt %, preferably 20 to 40 wt % and optimally 23 to 36 wt % of the particulate starting material.

The low bulk density component (i.e. the component of the starting material having a bulk density of no more than 600 g/l), suitably has a bulk density of 200 to 600 g/l, preferably 250 to 550 g/l and especially 350 to 500 g/l.

The particulate starting material may also contain a non-soap detergent active or precursor therefor, for example at a level of 5 to 40 wt % detergent active, preferably 8 to 30 wt %, particularly 10 to 24 wt %.

The particulate starting material comprises a detergent builder material, preferably at a level of 5–70 wt %.

The builder may comprise inorganic and/or organic builders. Suitable builders include sodium carbonate, aluminosilicates preferably zeolites, for example ZEOLITE A24, phosphates and polymeric builders for example polycarboxylates and acrylic/maleic acid copolymers. The builder may comprise a silicate, preferably a crystalline alumino silicate and optionally a zeolite and/or a salt, for example citrate.

Desirably the low bulk density component constitutes the detergency builder, or part thereof in the composition. The low bulk density component is preferably an aluminosilicate, for example zeolite 4A or zeolite A24 or a salt, preferably an inorganic salt. Salts, preferably sodium, of phosphates, for example tripolyphosphate, carbonate, bicarbonate and sulphate are especially suitable. Low bulk density calcite for example precipitated calcite, or sodium silicate are also particularly preferred. If desired, the low bulk density component may be a non-builder material, in which case the particulate starting material will suitably comprise a builder as a further component.

It is especially preferred that the low bulk density component comprises sodium tripolyphosphate having a bulk density of 380 to 500 g/l. This compares to a typical bulk density of 800 to 1000 g/l for tripolyphosphate conventionally employed in detergent compositions.

The particulate starting material may also include a solid neutralising agent (for example an inorganic alkaline salt such as sodium carbonate) for in situ neutralisation of acid detergent precursor as will be explained further below.

In a preferred embodiment of the invention, the particulate starting material comprises one or more of a carbonate salt at a level of 5 to 40 wt %, a zeolite at a level of 5 to 40 wt % and, as the low bulk density component, a phosphate salt at a level of 20 to 40 wt %.

Suitably the particulate starting material constitutes 30 to 70%, preferably 50 to 70% of the detergent composition.

The process may be continuous but is preferably batchwise.

A preferred type of mixer/granulator for use in the process of the invention is bowl-shaped and preferably has a substantially vertical stirrer axis. Especially preferred are mixers of the Fukae (Trade Mark) FS-G series manufactured by Fukae Powtech Kogyo Co., Japan; this apparatus is essentially in the form of a bowl-shaped vessel accessible via a top port, provided near its base with a stirrer having a substantially vertical axis, and a cutter positioned on a side wall. The stirrer and cutter may be operated independently of one another, and at separately variable speeds.

Other similar mixers found to be suitable for use in the process of the invention are the Diosna (Trade Mark) V series ex Dierks & Söhne, Germany; and the Pharma Matrix (Trade Mark) ex T K Fielder Ltd., England. Other similar mixers believed to be suitable for use in the process of the invention include the Fuji (Trade Mark) VG-C series ex Fuji Sangyo Co., Japan; and the Roto (Trade Mark) ex Zanchetta & Co srl, Italy.

Another mixer found to be suitable for use in the process of the invention is the Lodige (Trade Mark) FM series batch mixer ex Morton Machine Co. Ltd., Scotland. This differs from the mixers mentioned above in that its stirrer has a horizontal axis.

Granulation is preferably effected by running the mixer using both stirrer and cutter; a relatively short residence time (for example, 5–8 minutes for a 1000 to 1100 kg batch) is generally sufficient. The final bulk density can be controlled by choice of residence time.

Suitably the stirrer is operated at a rate of 20 to 95 rpm, preferably 25 to 80 rpm, though rates of 25 to 60 rpm, preferably 30 to 50 rpm can be used. Independently the cutter is suitably operated at a rate of 0 to 2000 rpm, preferably 200 to 2000 rpm more preferably 700 to 1900 rpm. A batch process typically involves pre-mixing of solid components, addition of liquids, granulation, optional addition of a layering material suitable for controlling the granulation end-point, and product discharge. The rate of stirring and/or cutting is suitably adjusted according to the stage of the process.

The mixing step is preferably carried out at a controlled temperature somewhat above ambient, preferably above 30° C. Suitably the temperature is within the range 30 to 60° C., preferably 30 to 45° C.

The presence of a liquid binder is necessary for successful granulation. The amount of binder added preferably does not exceed that needed to bring the free moisture content of the composition above about 6 wt %, since higher levels may lead to a deterioration in the flow properties of the final granulate. The binder may comprise liquid non-soap detergent active or detergent precursor. Preferably, the binder is liquid active such as anionic active, nonionic active or mixtures thereof. The moisture content of the composition may originate in moisture inherently contained in the particulate starting material, or in the liquid binder, particularly in liquid surfactants, or in both. Moisture is also generated when acid surfactant precursor is neutralised in situ. If necessary, water may be added before or during granulation. The liquid binder may be sprayed in while the mixer is running. The binder may be present in an amount of 5–40 wt % of the total composition, preferably 10–30 wt %, particularly 10–24 wt %.

The detergent composition suitably comprises anionic detergent active. This may be incorporated as a pre-neutralised material, desirably as a component of the particulate starting material, or may be neutralised in situ. In the latter case the acid precursor of the active is preferably neutralised using a solid neutralising agent, for example carbonate, which (as noted above) is desirably a component of the particulate starting material.

The detergent active material present in the composition may be selected from anionic, ampholytic, zwitterionic or nonionic detergent active materials or mixtures thereof. Examples of suitable synthetic anionic detergent compounds are sodium and potassium ($C_9$–$C_{20}$) benzene sulphonates, particularly sodium linear secondary alkyl ($C_{10}$–$C_{15}$) benzene sulphonates; sodium or potassium alkyl sulphates; and sodium alkyl glyceryl ether sulphates, especially those ethers of the higher alcohols derived from tallow or coconut oil and synthetic alcohols derived from petroleum. Suitable nonionics which may be employed include, in particular the reaction products of compounds having a hydrophobic group and a reactive hydrogen atom, for example, aliphatic alcohols, acids, amides or alkyl phenols with alkylene oxides, especially ethylene oxide either alone or with propylene oxide. Specific nonionic detergent compounds are alkyl ($C_6$–$C_{22}$) phenol ethylene oxide condensates, generally having 5 to 25 EO, ie 5 to 25 units of ethylene oxide per molecule, and the condensation products of aliphatic ($C_8$–$C_{18}$) primary or secondary linear or branched alcohols with ethylene oxide, generally 5 to 40 EO.

The level of detergent active material present in the composition may be in the range from 1 to 50% by weight depending on the desired applications. Nonionic material may be present in the particulate starting material at a level which is preferably less than 10% by weight, more preferably less than 5% by weight and/or employed as the liquid binder optionally with another liquid component, for example water.

Optionally, a layering material may be employed during the mixing step to control granule formation and reduce or prevent over-agglomeration. Suitable materials include aluminosilicates, for example zeolite 4A. The layering material is suitability present at a level of 1 to 6 wt %, preferably 1 to 4 wt %.

The composition of the invention may have good porosity. This improves the delivery of the powder into the wash liquor. Porosity is usually measured in specific pore volume ($cm^3/g$), for example using a porosimeter.

The specific total pore volume should be greater than 0.45 $cm^3/g$, preferably greater than 0.55 $cm^3/g$, more preferably greater than 0.7 $cm^3/g$.

The composition may be used as a complete composition in its own right or may be mixed with other components or mixtures and thus may form a major or minor part of a final product. The composition may be blended with for example a spray-dried base powder.

Conventional additional components such as enzymes, bleach and perfume may also be admixed, preferably post-dosed with the composition as desired to produce a fully formulated product.

The inventors have discovered that the compositions of the invention have good powder properties, that is the dynamic flow rate (DFR) can be greater than 100 ml/s, compression less than 10% and unconfined compression test results (UCT) less than 0.5 kg.

The invention is further illustrated by the following non-limiting Examples.

EXAMPLE 1 AND A (COMPARATIVE)

A detergent composition was prepared by dosing the following components into a Fukae FS3500 mixer (in the following sequence):

| | |
|---|---|
| Sodium Tripolyphosphate | 380 (kg) |
| Sodium Carbonate | 220 |
| Zeolite 4A | 120 |
| Fluorescer | 1 |
| SCMC | 20 |
| Fatty acid (PRISTERENE 4918) | 40 |
| *Fines | 100 |
| LAS acid | 170 |
| Nonionic | 30 |
| Zeolite 4A (layering) | 35 |

*fine material (<180 $\mu$m) of same composition from earlier run.

the process conditions employed are summarised below:

| Process step | Stirrer (rpm) | Cutter (rpm) |
|---|---|---|
| Solids premix | 40 | 1900 |
| Liquids addition | 35 | 1500 |
| Granulation | 37 | 1300 |
| Layering | 39 | 700 |
| Discharge | 30–45 | 400 |

The mixer was operated at a temperature of 30–35° C. The mixer was operated for sufficient time to effect granulation in the granulation step.

Two sets of experiments were conducted; one set (according to the invention) using STP having a bulk density of 400–440 g/l and a second set (comparative) using STP having a conventional bulk density of about 880 g/l.

The bulk density, volume compression, dynamic flow rate and unconfined compression test figures of the resultant powder were measured. The results are as follows:

TABLE I

| Example | 1(i) | 1(ii) | 1(iii) | 1(iv) | Ai) | Aii) |
|---|---|---|---|---|---|---|
| STP bd (g/l) | | ← 400–440 → | | | 880 | 880 |
| Product bd (g/l) | 640 | 640 | 590 | 670 | 830 | 850 |
| DFR (ml/s) | 114 | 108 | 116 | 131 | 133 | 131 |
| Compression % | — | — | 9 | — | 8 | 9 |
| UCT (kg) | — | — | 0.3 | — | 0.3 | 0.0 |

The results demonstrate that a medium bulk density powder is obtainable without the need for a spray-drying step in the production process. A reduction in bulk density would be expected to have an adverse effect on powder properties (compression, UCT). It is observed that these properties remain at an acceptable level for powders produced according to the invention.

EXAMPLE 2 AND B (COMPARATIVE)

A detergent composition was prepared by dosing the components listed in Example 1 into a Fukae FS3500 mixer in the sequence shown. Table II shows the bulk density of the STP used in Example 2 (according to the invention) and Example B (comparative) and the bulk density of the product. The process conditions were as set out in Example 1. The total pore volume of the resultant powders was measured using a micromeritics pore sizer porosimeter and the results are shown in Table II.

TABLE II

| Example | STP Bulk Density g/l | Product Bulk Density g/l | Pore Volume cc/g |
|---|---|---|---|
| Example 2 | 400–440 | 670 | 0.83 |
| Example B | 880 | 850 | 0.44 |

The results demonstrate that a powder having a good porosity can be obtained without the need for a spray drying step. The use of a Fukae mixer would be expected to produce a low porosity powder as in Example B, but the inventors have demonstrated that the porosity according to the invention can be good.

We claim:

1. A process for the production of detergent composition granules, which process does not comprise a spray-drying step and which process consists of:

granulating a particulate starting material comprising 10 wt. %–45 wt. % of a solid ingredient having a bulk density of not more than 600 g/l and which solid ingredient is not a detergent active compound with from 5 to 40 wt. % based on the weight of the detergent composition granules of a liquid binder in a mixer granulator having both a stirring and a cutting action with a stirrer operated at a rate of 20 to 95 rpm and a cutter operated at 200 to 2000 rpm, to form the granules with a bulk density of less than 700 g/l and pore volume greater than 0.55 $cm^3/g$, wherein the particulate starting material comprises a detergent builder and the particulate starting material and the liquid binder together comprise an anionic non-soap detergent active or a precursor therefor and a nonionic detergent active, the process optionally consisting of the steps of premixing solid components, liquids, addition, layering, and product discharging.

2. The process according to claim 1, wherein the detergent composition granules have a bulk density of from 400 to 680 g/l.

3. The process according to claim 1, wherein the detergent composition granules have a bulk density of from 450 to 680 g/l.

4. The process according to claim 1, wherein the detergent composition granules have a bulk density of from 500 to 650 g/l.

5. The process according to claim 1, wherein the detergent composition granules have a particle porosity of at least 0.25.

6. The process according to claim 1, wherein the solid ingredient is present at a level of from 20 to 40 wt % of the particulate starting material.

7. The process according to claim 1, wherein the solid ingredient is present at a level of from 23 to 36 wt % of the particulate starting material.

8. The process according to claim 1, wherein the solid ingredient has a bulk density of from 200 to 600 g/l.

9. The process according to claim 1, wherein the solid ingredient has a bulk density of from 250 to 550 g/l.

10. The process according to claim 1, wherein the solid ingredient has a bulk density of from 350 to 550 g/l.

11. The process according to claim 1, wherein the detergent builder is contained in the solid ingredient of the particulate starting material.

12. The process according to claim 1, wherein the solid ingredient is selected from the group consisting of aluminosilicates; salts of phosphates, carbonates, bicarbonates and sulphates; calcite, sodium silicate; and mixtures thereof.

13. The process according to claim 1, wherein the solid ingredient comprises sodium tripolyphosphate having a bulk density of from 380 to 500 g/l.

14. The process according to claim 1, wherein the particulate starting material constitutes from 30 to 70 wt % of the detergent composition granules.

* * * * *